US007975885B2

(12) United States Patent
Chan

(10) Patent No.: US 7,975,885 B2
(45) Date of Patent: Jul. 12, 2011

(54) GARMENT HANGER

(75) Inventor: King Keung Kennedy Chan, Hong Kong (HK)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 119 days.

(21) Appl. No.: 12/331,063

(22) Filed: Dec. 9, 2008

(65) Prior Publication Data

US 2010/0140306 A1 Jun. 10, 2010

(51) Int. Cl.
*A41D 27/22* (2006.01)

(52) U.S. Cl. ..... 223/92; 223/85; 223/95

(58) Field of Classification Search ..... 223/85, 223/88, 92, 95, 96
See application file for complete search history.

(56) References Cited

U.S. PATENT DOCUMENTS 4,607,771 A * 8/1986 Massion ..... 223/91
4,951,855 A * 8/1990 Jacobson et al. ..... 223/88
5,071,045 A * 12/1991 Hollis ..... 223/92
6,119,906 A * 9/2000 Bond et al. ..... 223/96
6,435,387 B1 * 8/2002 Gouldson et al. ..... 223/96
6,588,634 B2 * 7/2003 Gouldson et al. ..... 223/96
2005/0284898 A1 * 12/2005 Fleming ..... 223/85
2006/0113335 A1 * 6/2006 Ritzmann et al. ..... 223/96

* cited by examiner

*Primary Examiner* — Gary L. Welch
*Assistant Examiner* — Nathan E Durham
(74) *Attorney, Agent, or Firm* — Leason Ellis LLP

(57) ABSTRACT

A garment hanger includes a body having a hook member that extends outwardly from a cross bar that has a first end and an opposite second end. The cross bar has a first end portion that terminates at the first end, a second end portion that terminates at the second end, and a central portion disposed between the first end portion and the second end portion. The hook member is coupled to the central portion, wherein a cross-section of each of the first and second end portions has a first shape and a cross-section of the central portion has a second shape that is different than the first shape. In one embodiment, the first shape is an I-shape and the second shape is a Z-shape.

10 Claims, 4 Drawing Sheets

100
110
120
121
122
123
124
125
130
131
132
133
135
140
142
150
3
4
5
6

300
350
335
321
323
342
335
11
11
330
323
310
321
332
13
13
323
340
335
321
12
12
321
335
323

321
335
323

321
335
332
323

121
135
123

GARMENT HANGER

TECHNICAL FIELD

The present invention relates to a garment hanger and more particularly, to a garment hanger that has a cross-bar construction that has a Z-shape cross-section to allow for a reduction of material needed to form the cross bar while maintaining structural integrity.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

As shown in FIG. 1, a conventional garment hanger 10 includes a hook member 20 that extends from a cross bar 30 to permit hanging of the garment hanger 10 and can include clamp members at ends of the cross bar or can include other means, generally indicated at 40, that assists in securing a garment to the hanger 10. Garment hangers 10 are typically formed of plastic materials that are molded in shape and are often transparent in nature.

The cross bar 30 is an elongated structure and includes a first end 32 and an opposing second end 34. The cross bar 30 can be divided into a number of sections, including a central portion 50 and two end portions 60, 70 on opposite sides of the central portion 50.

The cross bar 30 has a first edge 33 that represents the top edge of the cross bar 30 and an opposite second edge 35 that represents the bottom edge thereof. The interface between the central portion 50 and each of the end portions 60, 70 is defined by a curved, upwardly bent portion. The top edge 33 can be a convex edge or a planar edge and the bottom edge 35 generally has at least one portion that is concave.

The means 40 can be in the form of a fastener clip that includes a recessed portion 41 as well as two flexible fingers 42 under which the garment is fitted into a space 43 between the fingers 42 and a floor 45 of the recessed portion 41. The flexible fingers 42 are flexible to allow insertion and removal of a garment under the fingers 42 between the fingers 42 and floor 45. A gap or space 47 is formed between distal ends of the fingers 42 through which the garment is inserted and then inserted under the fingers 42 which retain the garment along the hanger 10.

As with other conventional garment hangers, the garment hanger 10 has an I-shaped cross bar 30 due to the cross-sectional shape thereof being generally I-shaped. In other words, the cross bar 30 is defined by a planar wall or surface 80 that is bordered along its two edges 33, 35 by first and second walls 90, 92 that extend perpendicularly from the planar wall 80. The walls 90, 92 extend perpendicular relative to both a front surface and an opposite rear surface of the planar wall 80. The I-shaped nature of the cross bar 30 extends from both the first end 32 and the second end 34.

SUMMARY

A garment hanger includes a body having a hook member that extends outwardly from a cross bar that has a first end and an opposite second end. The cross bar has a first end portion that terminates at the first end, a second end portion that terminates at the second end, and a central portion disposed between the first end portion and the second end portion. The hook member is coupled to the central portion, wherein a cross-section of each of the first and second end portions has a first shape and a cross-section of the central portion has a second shape that is different than the first shape. In one embodiment, the first shape is an I-shape and the second shape is a Z-shape.

In another embodiment, a garment hanger includes a body having a hook member that extends outwardly from a cross bar that has a first end and an opposite second end. The cross bar has a first end portion that terminates at the first end, a second end portion that terminates at the second end, and a central portion disposed between the first end portion and the second end portion. The hook member is coupled to the central portion. The cross bar has a base surface, a top flange that extends along at least a portion of a top edge of the cross bar, and a bottom flange that extends along at least a portion of a bottom edge of the cross bar. The cross bar has a front face and an opposite rear face and wherein the bottom flange is at least substantially eliminated in the central portion of one of the first and second faces and wherein the top flange is at least substantially eliminated in the central portion of the other of the first and second faces.

Other features and advantages of the present invention will be apparent from the following detailed description when read in conjunction with the accompanying drawings.

BRIEF DESCRIPTION OF THE DRAWINGS FIGURES

The foregoing and other features of the present invention will be more readily apparent from the following detailed description and drawings figures of illustrative embodiments of the invention in which.

DETAILED DESCRIPTION OF EMBODIMENTS

Figure 1:
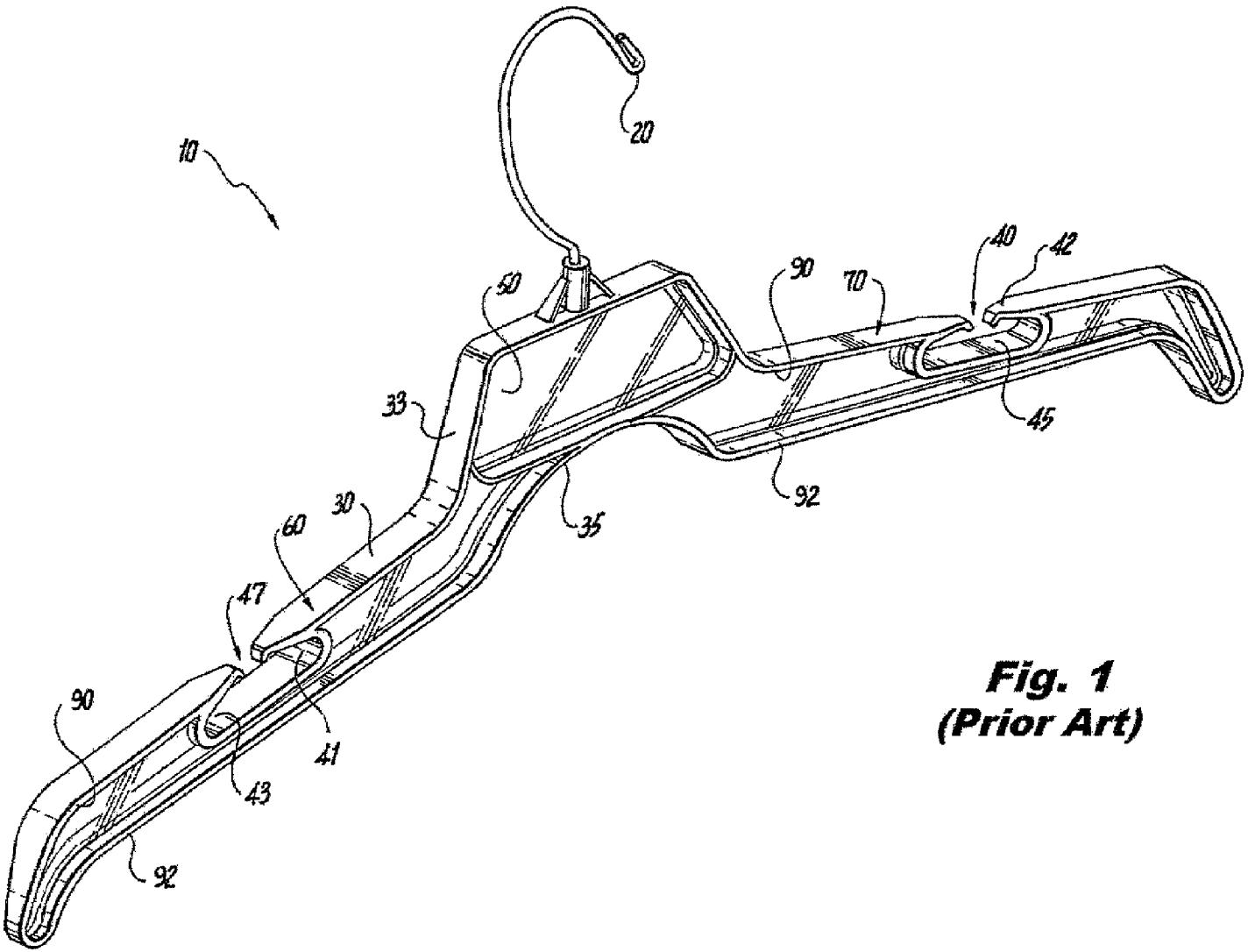
Fig. 1 (Prior Art)
FIG. 1 is a front perspective view of a conventional garment hanger.

Referring now to FIGS. 2-6, FIG. 2 is a front elevation view of a garment hanger 100 according to one exemplary embodiment of the present invention. Similar to the garment hanger 10 of FIG. 1, the garment hanger 100 includes a hook member 110 that extends from a cross bar 120 to permit hanging of the garment hanger 100 and can include clamp members at ends of the cross bar 120 or can include other means, generally indicated at 125, that assists in securing a garment to the hanger 100. The garment hanger 100 is formed of a plastic material that is molded in shape and is transparent in nature.

The cross bar 120 is an elongated structure and includes a first end 122 and an opposing second end 124. The cross bar 120 can be divided into a number of sections, including a central portion 130 and two end portions 140, 150 on opposite sides of the central portion 130. A first interface 132 is formed between the central portion 130 and end portion 140 and a second interface 142 is formed between the central portion 130 and the end portion 150.

The cross bar 120 has a first flange or lip 121 that represents the top edge of the cross bar 120 and an opposite second flange or lip 123 that represents the bottom edge thereof. The interface between the central portion 130 and each of the end portions 140, 150 is defined by a curved, upwardly bent portion such that the central portion 130 is elevated compared to the end portions 140, 150. The top edge is generally a convex edge and the bottom edge is generally a concave edge.

The central portion 130 has a base surface or substrate 135 that extends between the first flange 121 at the top edge and the second flange 123 at the bottom edge 123. The central portion 130 also a first face or surface (front) 131 and an opposing second face or surface (rear) 133.

In accordance with the present invention, the garment hanger 100 has a cross-sectional shape that is not uniform throughout (e.g., from the first end 122 to the second end 124). This is in direct contrast to conventional garment hangers, such as garment hanger 10, which have a single cross-sectional shape and in particular, have an I-shape cross-section throughout the entire body of the hanger 10.

Figures 2, 3, 4, 5, 6:
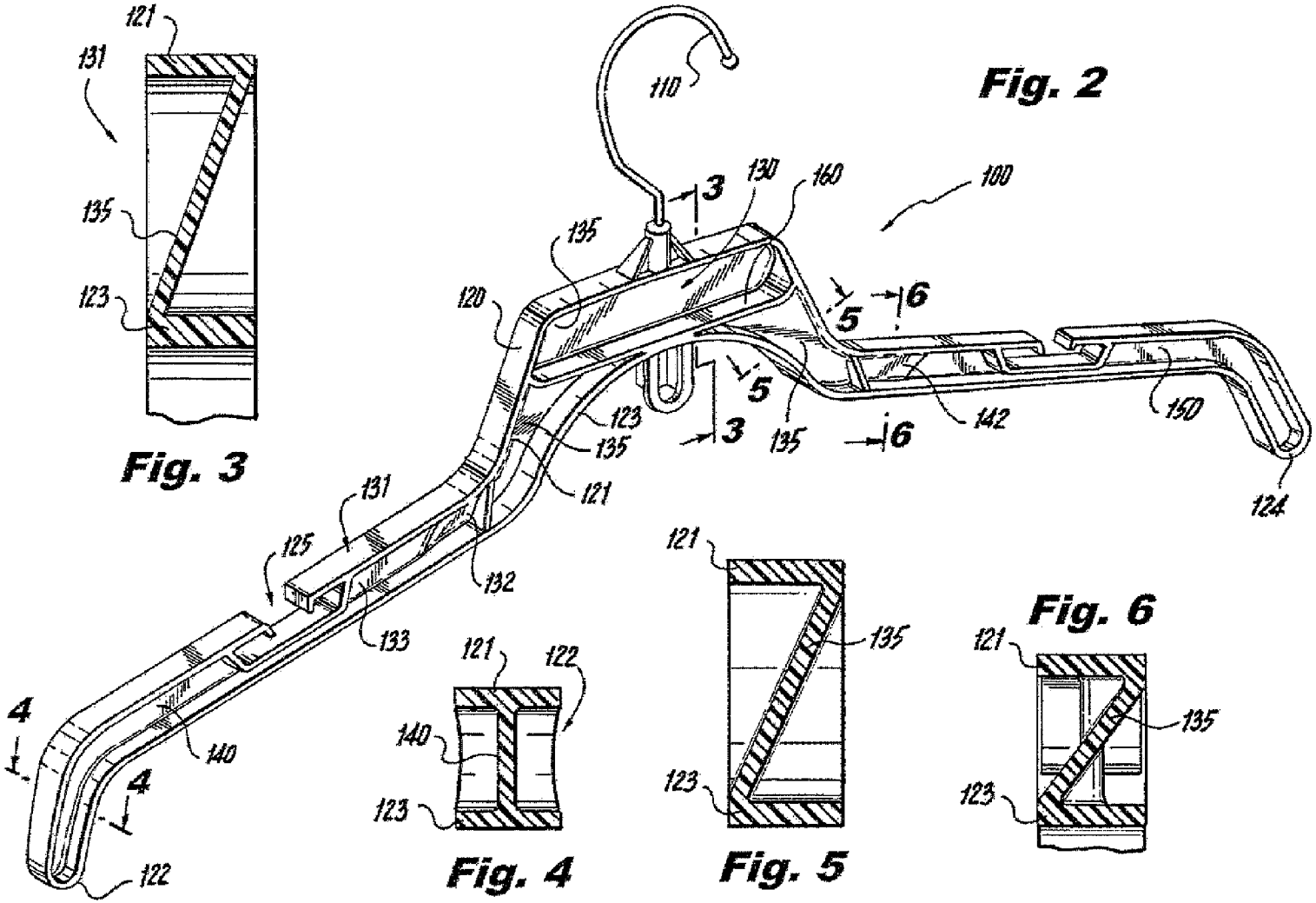
FIG. 2 is a front perspective view of a garment hanger according to a first embodiment of the present invention.
FIG. 3 is a cross-sectional view taken along the line 3-3 of FIG. 2.
FIG. 4 is a cross-sectional view taken along the line 4-4 of FIG. 2.
FIG. 5 is a cross-sectional view taken along the line 5-5 of FIG. 2.
FIG. 6 is a cross-sectional view taken along the line 6-6 of FIG. 2.

In one embodiment, the central portion 130 has a first cross-sectional shape, while the end portions 140, 150 have a second cross-sectional shape that is different from the first cross-sectional shape. More specifically, the end portion 140 and the end portion 150 can have a conventional I-shape cross-section as shown in FIG. 4, while the central portion 130 has a different cross-section. The interface between the end portion 140 and central portion 130 and the end portion 150 and central portion 130 define a transition from the first cross-sectional shape to the second cross-sectional shape.

In one embodiment, the cross-sectional shape of the central portion 130 can be described as having a Z-shape in that for each face 131, 133 of the central portion 130, substantially only one of the flanges 121, 123 is upstanding and extending outwardly from the base surface 135 of the central portion 130. Similarly, on the other opposite face 131, 133, substantially one of the other flanges 121, 123 is upstanding and extending outwardly from the base surface 135. More specifically, the first face 131 can be defined as having an outwardly extending (radially outward) first flange 121 along the top edge of the central portion 130, while at the bottom edge, the first face 131 substantially does not include an outwardly extending (radially outward) second flange 123 but rather, the transition between the bottom edge and the base surface 135 is substantially smooth along the first face 131. Conversely, the second face 133 can be defined as having an outwardly extending (radially outward) second flange 123 along the bottom edge of the central portion 130, while at the top edge, the second face 133 substantially does not include an outwardly extending (radially outward) first flange 121 but rather, the transition between the top edge and the base surface 135 is substantially smooth along the second face 133. Since each face only has one radially outward flange, the overall cross-sectional shape of the central portion 130 is Z-shaped.

When viewing the first face 131, the second flange 123 extends outwardly and is present along the bottom edge of both the end portion 140 and the end portion 150; however, in the central portion 130, the second flange 123 is not present. As a result, the second flange 123 smoothly fades into the transition area between the end portion 140 and the central portion 130 and smoothly fades into the transition area between the end portion 150 and the central portion 130 as shown in FIG. 6. The bottom edge of the central portion 130 is thus substantially smooth. The first flange 121 extends outwardly from the base surface 135 and is present in each of the end portion 140, the central portion 130 and the end portion 150. The first flange 121 is thus continuous from a distal end of the end portion 140 to the distal end of the end portion 150.

Conversely, when viewing the second face 133, the first flange 121 extends outwardly and is present along the top edge of both the end portion 140 and the end portion 150; however, in the central portion 130, the first flange 121 is not present. As a result, the first flange 121 smoothly fades into the transition area between the end portion 140 and the central portion 130 and smoothly fades into the transition area between the end portion 150 and the central portion 130. The top edge of the central portion 130 is thus substantially smooth.

Based on the foregoing construction, each face 131, 133 of the central portion 130 only includes a single flange and the edge opposite the edge where the flange is present. This results in the Z-shape cross-section of the central portion 130.

By forming at least one portion of the garment hanger 100 to have a Z-shape cross-section, the overall weight of the garment hanger 100 is reduced compared to the conventional garment hanger 10 and therefore, the manufacturing cost thereof is reduced due to less material being needed to form the garment hanger 100. However, the Applicant has realized that the Z-shape cross-section of at least one portion of the garment hanger 100 does not jeopardize the structural integrity of the garment hanger 100. Since the center of the garment is disposed within the central portion 130 when the garment is hung on the hanger 100, the strength of the central portion 130 is of importance.

The central portion 130 is also a load bearing surface (area) since the garment hangs and is fastened to the end portions 140, 150 which act as arms that extend outwardly from the central portion 130 and therefore, the central portion 130 bears the weight of the garment.

Figures 10, 11, 12, 13, 14:
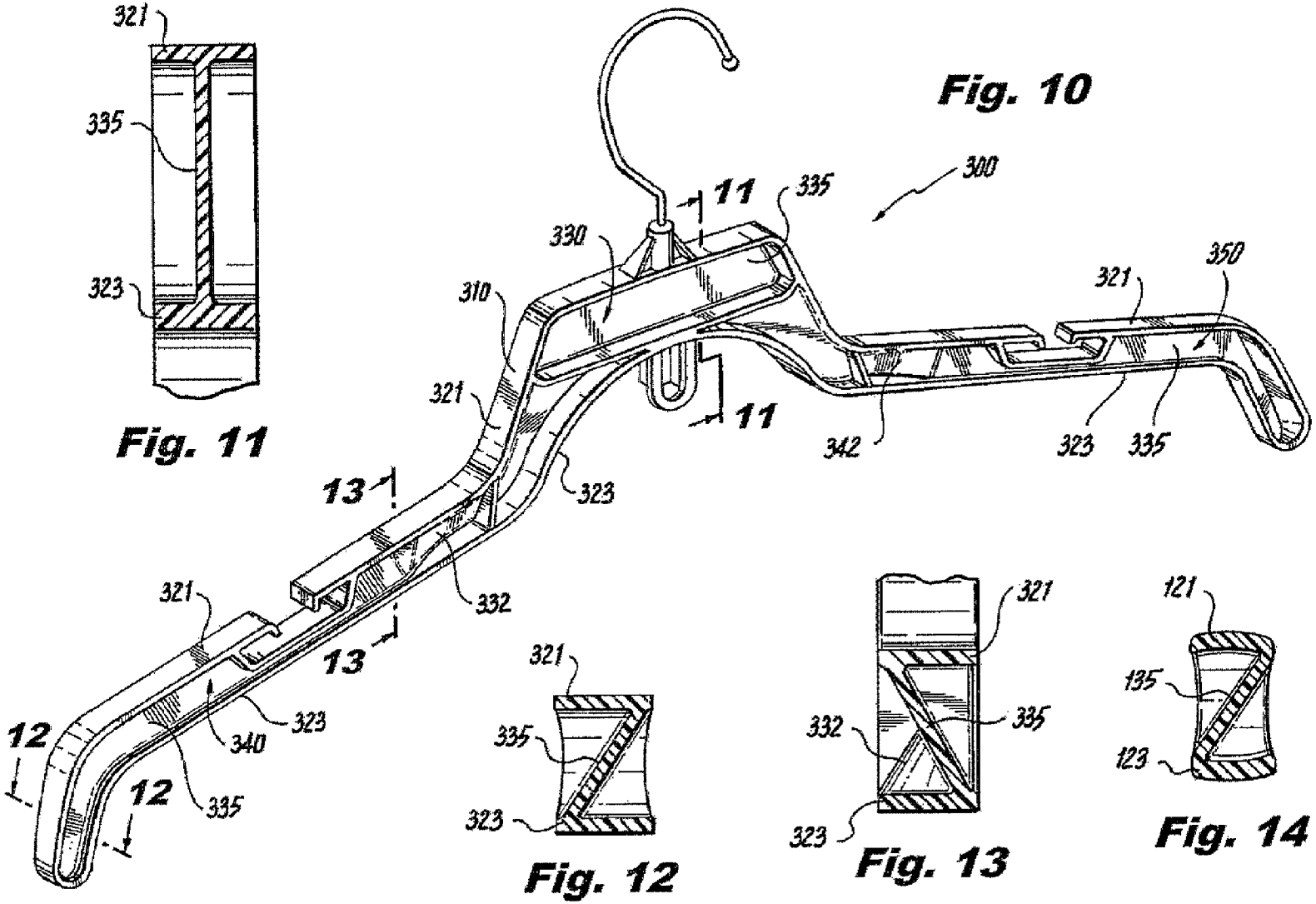
FIG. 10 is a front perspective view of a garment hanger according to a third embodiment of the present invention.
FIG. 11 is a cross-sectional view taken along the line 11-11 of FIG. 10.
FIG. 12 is a cross-sectional view taken along the line 12-12 of FIG. 10.
FIG. 13 is a cross-sectional view taken along the line 13-13 of FIG. 10.
FIG. 14 is a cross-sectional view of a portion of a garment hanger according to a fourth embodiment.

It will be appreciated that the flanges 121, 123 that are present in the central portion 130 on either of the faces 131, 133, are not limited to being flanges that are perpendicular to the base surface 135 but the flanges 121, 123 can be arcuate shaped edges and therefore, the cross-section of the central portion 130 is more in the shape of an "S" in this embodiment as shown in FIG. 14. In addition, the flanges 121, 123 can have other shapes.

Conventional garment hangers have a base surface in the central portion that is a flat surface that is perpendicular to the flanges at the top and bottom edges. In a vertical, upright position, the base surface of the central portion perpendicular to a ground surface. In contrast, the base surface 135 of the central portion 130 in the current hanger 100 is a beveled surface in that in a vertical, upright position, the base surface 135 is at an angle relative to the ground surface.

A reinforcing rib 160 can be formed in the central portion 130 and extend across the central portion 130 between two points along the top edge of the central portion. In the vertical, upright position, the rib 160 lies parallel to the ground surface. The rib 160 extends outwardly from the base surface 135 and can be formed perpendicular thereto. The rib 160 can also come into contact with a bottom edge of the hanger. The rib 160 imparts additional structural integrity to the central portion.

Figures 7, 8, 9:
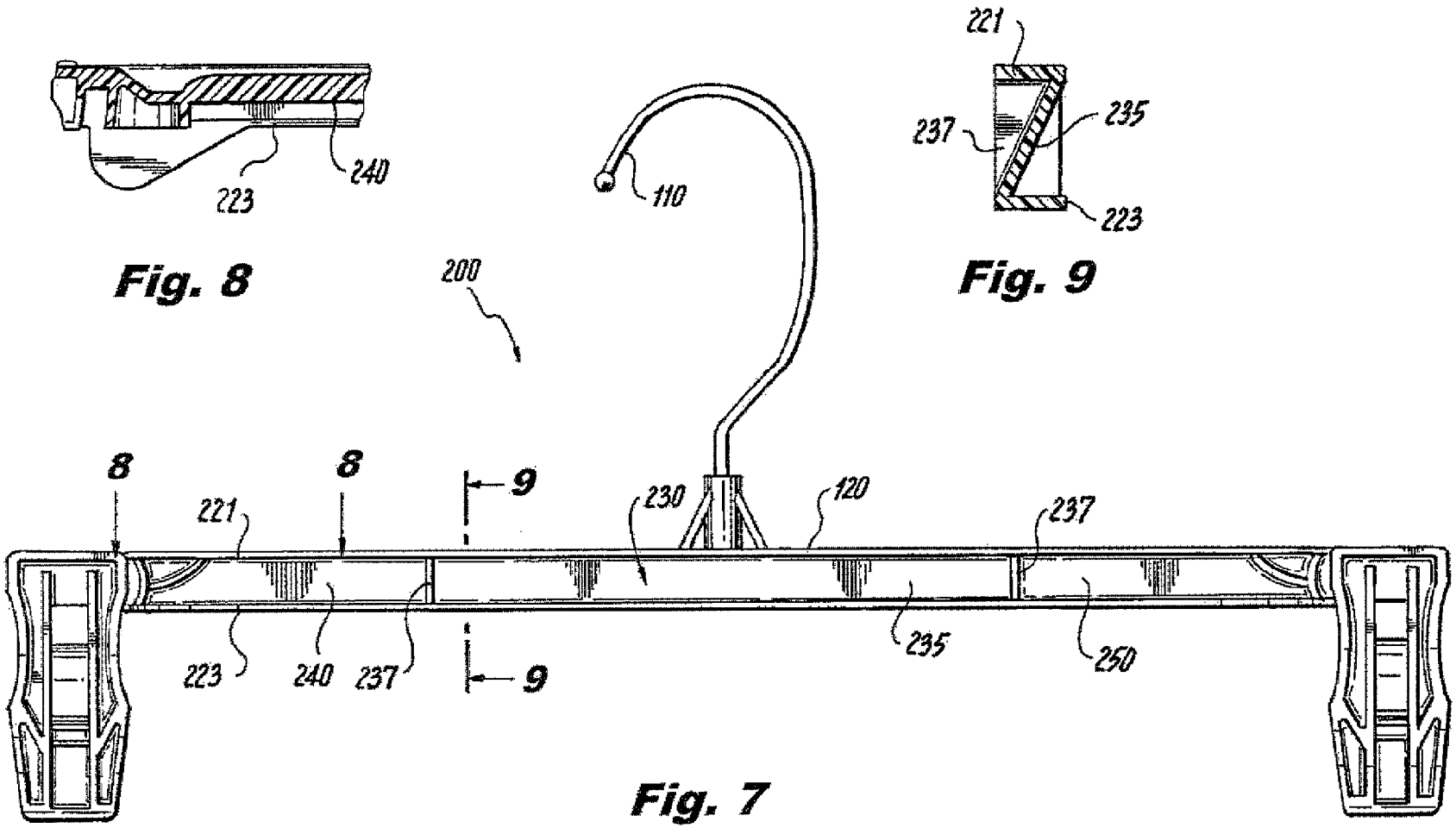
FIG. 7 is a front elevation view of a garment hanger according to a second embodiment of the present invention.
FIG. 8 is a cross-sectional view taken along the line 8-8 of FIG. 7.
FIG. 9 is a cross-sectional view taken along the line 9-9 of FIG. 7.

FIGS. 7-9 illustrate a garment hanger 200 according to another embodiment that is similar to garment hanger 100; however, garment hanger 200 is of a different type (e.g., pants hanger) and therefore has a different construction. However, garment hanger 200 shares some of the features of garment hanger 100 and in particular, garment hanger 200 has a portion (center portion 230) that has a different cross-section than end portions 240, 250. In this embodiment, center portion 230 is a center portion disposed between end portions 240, 250 and is the portion of the hanger from which the hook member 110 is attached. A rib 237 can be formed at an interface between end portion 240 and center portion 230 and between end portion 250 and center portion 230.

The cross bar 120 of the hanger 200 is defined by a first edge (lip or flange) 221 and a second edge (lip or flange) 223 with a base section 235 formed therebetween. The first and second edges 221, 223 extend outwardly from the base section 235.

The cross-section of the center portion 230 is Z-shaped or S-shaped or another shape so long as each face of the hanger only substantially includes one lip or flange as described in the embodiment of FIGS. 2-6.

In one embodiment, the cross-sectional shape of the central portion 230 can be described as having a Z-shape in that for each face (front and rear) of the central portion 230, substantially only one of the flanges 221, 223 is upstanding and extending outwardly from the base surface 235 of the central portion 230. Similarly, on the other opposite face substantially one of the other flanges 221, 223 is upstanding and extending outwardly from the base surface 235. More specifically, the first face can be defined as having an outwardly extending (radially outward) first flange 221 along the top edge of the central portion 230, while at the bottom edge, the first face 231 substantially does not include an outwardly extending (radially outward) second flange 223 but rather, the transition between the bottom edge and the base surface 235 is substantially smooth along the first face 231. Conversely, the second face can be defined as having an outwardly extending (radially outward) second flange 223 along the bottom edge of the central portion 230, while at the top edge, the second face 233 substantially does not include an outwardly extending (radially outward) first flange 221 but rather, the transition between the top edge and the base surface 235 is substantially smooth along the second face. Since each face only has one radially outward flange, the overall cross-sectional shape of the central portion 230 is Z-shaped.

When viewing the first face, the second flange 223 extends outwardly and is present along the bottom edge of both the end portion 240 and the end portion 250; however, in the central portion 230, the second flange 223 is not present. As a result, the second flange 223 smoothly fades into the transition area between the end portion 240 and the central portion 230 and smoothly fades into the transition area between the end portion 250 and the central portion 230. The bottom edge of the central portion 230 is thus substantially smooth. The first flange 221 extends outwardly from the base surface 235 and is present in each of the end portion 240, the central portion 230 and the end portion 250. The first flange 221 is thus continuous from a distal end of the end portion 240 to the distal end of the end portion 250.

Conversely, when viewing the second face, the first flange 221 extends outwardly and is present along the top edge of both the end portion 240 and the end portion 250; however, in the central portion 230, the first flange 221 is not present. As a result, the first flange 221 smoothly fades into the transition area between the end portion 240 and the central portion 230 and smoothly fades into the transition area between the end portion 250 and the central portion 230. The top edge of the central portion 230 is thus substantially smooth.

Based on the foregoing construction, each face of the central portion 230 only includes a single flange and the edge opposite the edge where the flange is present. This results in the Z-shape cross-section of the central portion 230.

FIGS. 10-13 show a garment hanger 300 according to another embodiment similar to the other embodiments described herein. The garment hanger 300 is similar to garment hanger 100 in that it includes a cross bar 310 that has more than one cross-sectional shape; however, in the garment hanger 300, the end portions 340, 350 are the portions that have a first cross-section that is Z-shaped, S-shaped, or another shape where the base section 335 is angled (beveled) relative (other than 90 degrees) to the top and bottom edges 321, 323. The center portion 330 has an I-shape cross-section as shown in FIG. 11. Transition regions 332, 342 mark the transition from the I-shape cross-section to the Z-shape, S-shape cross-section.

The advantages of the garment hanger 300 is similar to the garment hanger 100 in that a reduction in material cost is realized, while structural integrity is maintained.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A garment hanger comprising:

a body having a hook member that extends outwardly from a cross bar that has a first end and an opposite second end, the cross bar having a first end portion that terminates at the first end, a second end portion that terminates at the second end, and a central portion disposed between the first end portion and the second end portion, the hook member being coupled to the central portion, wherein a cross-section of each of the first and second end portions has a first shape and a cross-section of the central portion has a second shape that is different than the first shape;

wherein the central portion has a base surface between a top edge and a bottom edge of the central portion, the base surface being a beveled surface relative to the top and bottom edges;

wherein the body has a first transition zone where the first end portion interfaces with the central portion and a second transition zone where the second end portion interfaces with the central portion, wherein in the first transition zone, one of a top flange and a bottom flange that define the top and bottom edges, respectively, tapers downward and flows into the base portion of the central portion and wherein in the second transition zone, one of a top flange and a bottom flange that define the top and bottom edges, respectively, tapers downward and flows into the base portion of the central portion.

2. The garment hanger of claim 1, wherein the first shape is an I-shape and the second shape is a Z-shape.

3. The garment hanger of claim 1, wherein an angle formed between the base surface and at least one of the top and bottom edges is other than 90 degrees.

4. The garment hanger of claim 1, wherein the body is a molded plastic part.

5. A garment hanger comprising:

a body having a hook member that extends outwardly from a cross bar that has a first end and an opposite second end, the cross bar having a first end portion that terminates at the first end, a second end portion that terminates at the second end, and a central portion disposed between the first end portion and the second end portion, the hook member being coupled to the central portion, wherein a cross-section of each of the first and second end portions has a first shape and a cross-section of the central portion has a second shape that is different than the first shape;

wherein the body has a front face and an opposite rear face, wherein a top flange that defines the top edge of the front face and extends outwardly from a base surface of the body is continuous along the top edge from the distal end of the first end portion, through the central portion to the distal end of the second end portion, whereas, a bottom flange that defines the bottom edge of the front face and extends outwardly from a base surface of the body is interrupted and substantially absent in the central portion, and wherein a bottom flange that defines the bottom edge of the rear face and extends outwardly from a base surface of the body is continuous along the bottom edge from the distal end of the first end portion, through the central portion to the distal end of the second end portion, whereas, a top flange that defines the top edge of the rear face and extends outwardly from a base surface of the body is interrupted and substantially absent in the central portion.

6. The garment hanger of claim 5, wherein the top flange and bottom flange are formed substantially perpendicular to the base surface.

7. A garment hanger comprising:

a body having a hook member that extends outwardly from a cross bar that has a first end and an opposite second end, the cross bar having a first end portion that terminates at the first end, a second end portion that terminates at the second end, and a central portion disposed between the first end portion and the second end portion, the hook member being coupled to the central portion, wherein the central portion has a base surface between a top edge and a bottom edge of the central portion, wherein an angle formed between the base surface and at least one of the top and bottom edges in the central portion is other than 90 degrees, wherein each of the first end portion and the second end portion has a base surface between a top edge and a bottom edge, wherein the base surface is perpendicular to both the top edge and the bottom edge in each of the first end portion and the second end portion, the base surface transitioning between each end portion and the center portion from being perpendicular to being angled.

8. The hanger of claim 7, wherein a cross-section of the central portion is generally Z-shape, with the base surface extending uninterrupted between the top edge and the bottom edge.

9. The hanger of claim 7, wherein the cross bar has a front face and an opposite rear face and includes a base surface and a top flange that extends radially outward from the base surface along the top edge and a bottom flange that extends radially outward from the base surface along the bottom edge, wherein in one of the front and rear faces, the top flange is interrupted and discontinuous and in the other of the front and rear faces, the bottom flange is interrupted and discontinuous.

10. The hanger of claim 7, wherein the top flange and bottom flange are formed at least substantially perpendicular to the base surface.

* * * * *